US006969112B1

(12) United States Patent
Sherrill

(10) Patent No.: US 6,969,112 B1
(45) Date of Patent: Nov. 29, 2005

(54) COLLAPSIBLE CHAIR ASSEMBLY

(76) Inventor: Milton Sherrill, P.O. Box 2421, Mt. Vernon, NY (US) 10551

( * ) Notice: Subject to any disclaimer, the term of this patent is extended or adjusted under 35 U.S.C. 154(b) by 0 days.

(21) Appl. No.: 10/767,523

(22) Filed: Jan. 29, 2004

Related U.S. Application Data

(60) Provisional application No. 60/443,390, filed on Jan. 29, 2003.

(51) Int. Cl.[7] ..... A47C 4/00
(52) U.S. Cl. ..... 297/16.1; 297/17; 297/51; 297/378.1; 297/344.18
(58) Field of Search ..... 297/16.1, 17, 54, 297/344.18, 51, 440.1, 440.24, 378.1

(56) References Cited

U.S. PATENT DOCUMENTS

| | | | | |
|---|---|---|---|---|
| 2,615,500 | A * | 10/1952 | Thomas | 297/54 X |
| 2,966,204 | A * | 12/1960 | Caravias | 297/17 |
| 3,765,718 | A * | 10/1973 | Chen | 297/17 X |
| 3,909,061 | A * | 9/1975 | Johnson | 297/17 |
| 4,193,630 | A * | 3/1980 | Steele | 297/17 |
| 4,889,383 | A * | 12/1989 | Jones | 297/16.1 X |
| 5,364,163 | A | 11/1994 | Hardison | |
| 5,494,333 | A | 2/1996 | Wilson | |
| 6,095,607 | A | 8/2000 | Wenzel | |
| 6,698,830 | B1 * | 3/2004 | Gaines | 297/344.18 |

* cited by examiner

*Primary Examiner*—Anthony D. Barfield

(57) ABSTRACT

A collapsible chair assembly includes a base portion, a back portion, and a plurality of telescopic legs that are pivoted on the base portion. Foot members are provided and may be frictionally engaged to the underside surface of the base portion or on the bottom of the legs when desired to facilitate support on a surface such as sand.

17 Claims, 8 Drawing Sheets

COLLAPSIBLE CHAIR ASSEMBLY

CROSS REFERENCE TO RELATED APPLICATION

This application claims the benefit of U.S. Provisional Application No. 60/443,390, filed Jan. 29, 2003.

BACKGROUND OF THE INVENTION

1. Field of the Invention

The present invention relates to chairs and more particularly pertains to a new collapsible chair assembly for providing a lightweight easily transported chair for use on various types of terrain.

2. Description of the Prior Art

The use of collapsible chairs is known in the prior art. U.S. Pat. No. 6,095,607 issued to Wenzel on Aug. 1, 2000, describes a universal chair having four separately adjustable length legs. Another type of collapsible chair is U.S. Pat. No. 5,364,163 issued to Hardison on Nov. 15, 1994, disclosing spiked leg members and telescoping back legs for stably positioning the chair on a sloped surface. U.S. Pat. No. 5,494,333 issued to Wilson on Feb. 27, 1996, discloses individually adjustable legs with leveling feet.

While these devices fulfill their respective, particular objectives and requirements, the need remains for a collapsible chair that collapses completely into a compact unit and provides for storage of chair accessories.

SUMMARY OF THE INVENTION

The present invention generally comprises a base portion, a back portion, and a plurality of telescopic legs that are pivoted on the base portion. Foot members are provided and may be frictionally engaged to the underside surface of the base portion or on the bottom of the legs when desired to facilitate support on a surface such as sand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
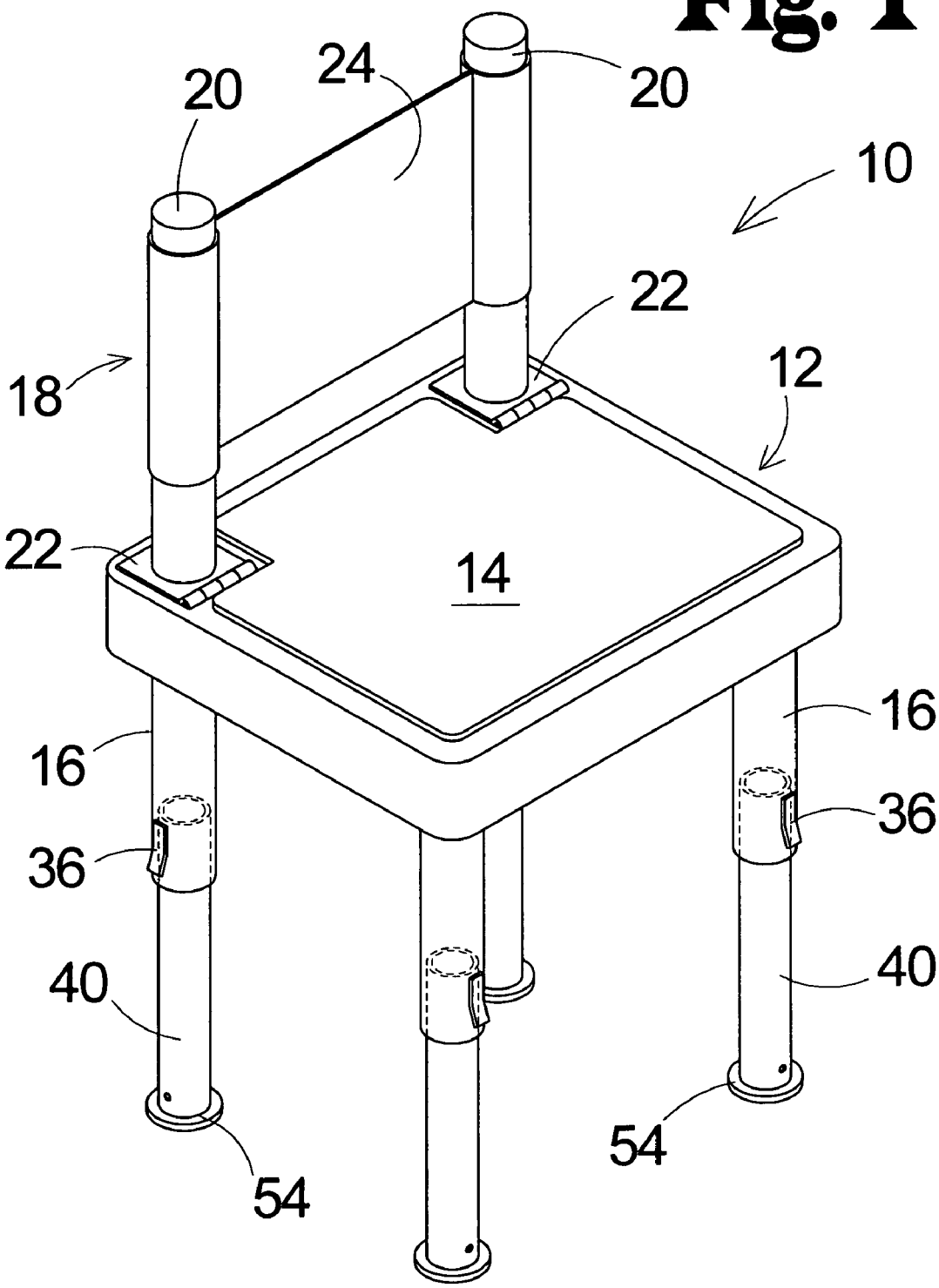
FIG. 1 is a perspective view of a new collapsible chair assembly according to the present invention.
Figure 2:
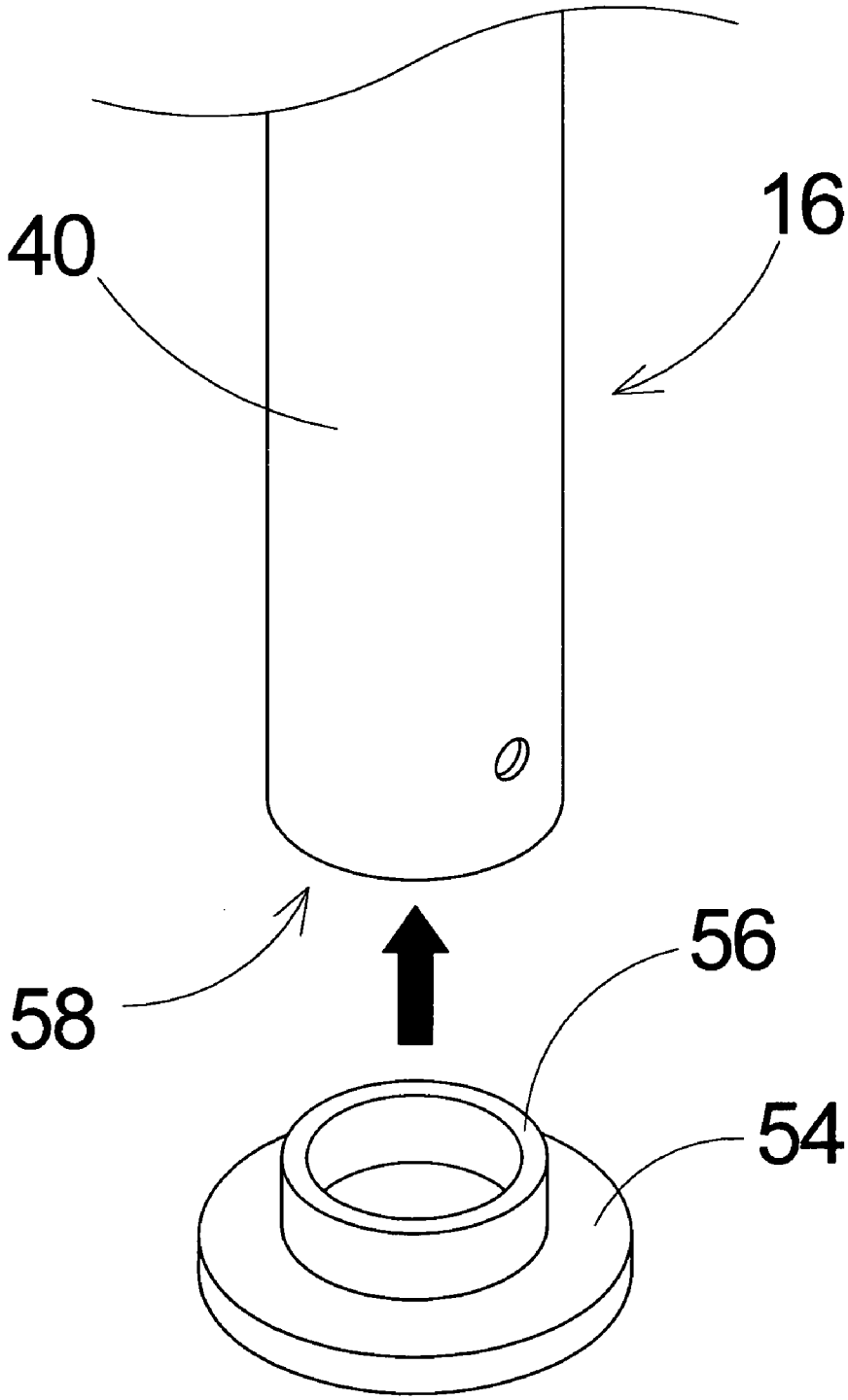
FIG. 2 is an enlarged view of the foot members of the present invention.
Figure 3:
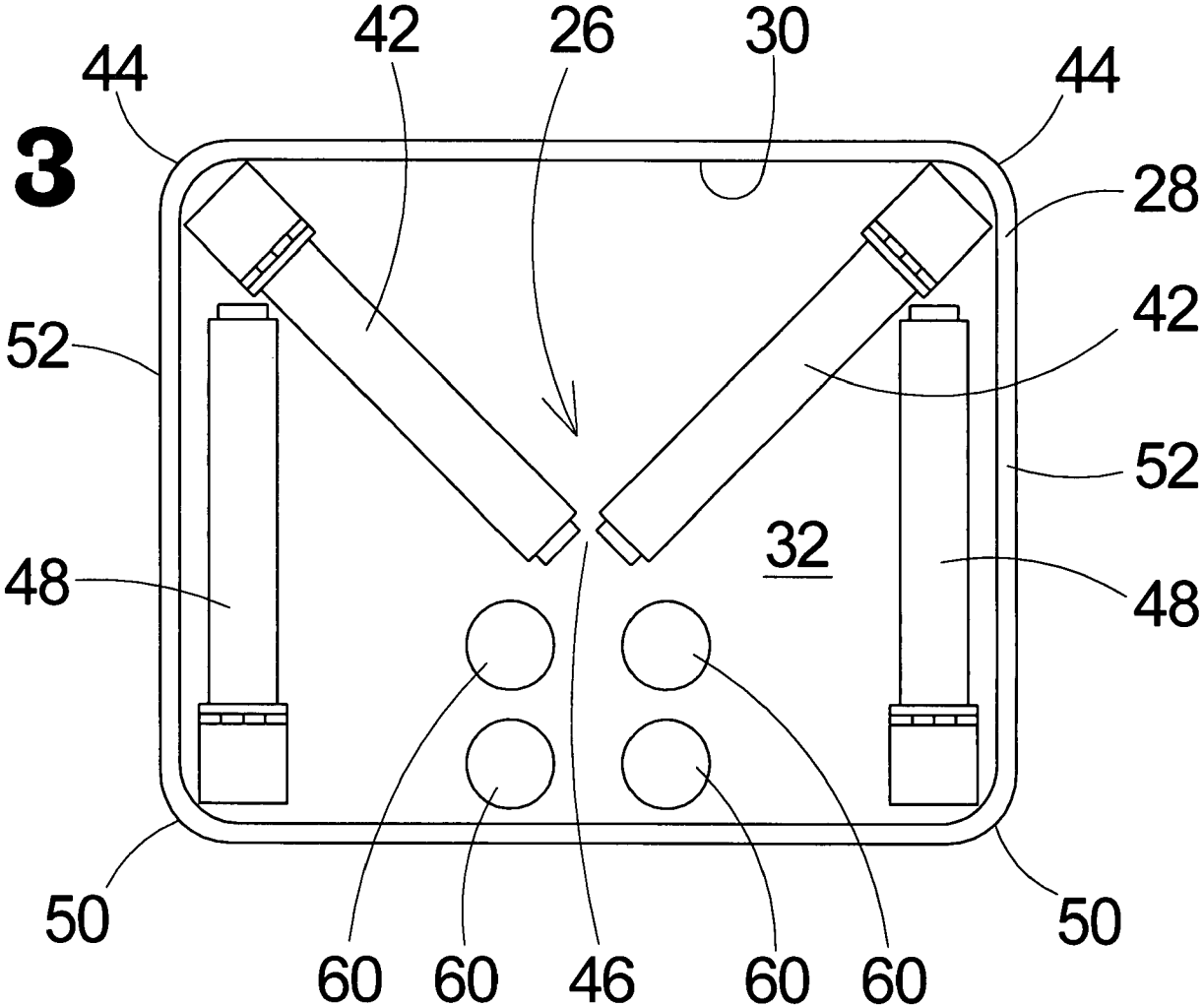
FIG. 3 is a bottom view of the present invention.
Figure 4:
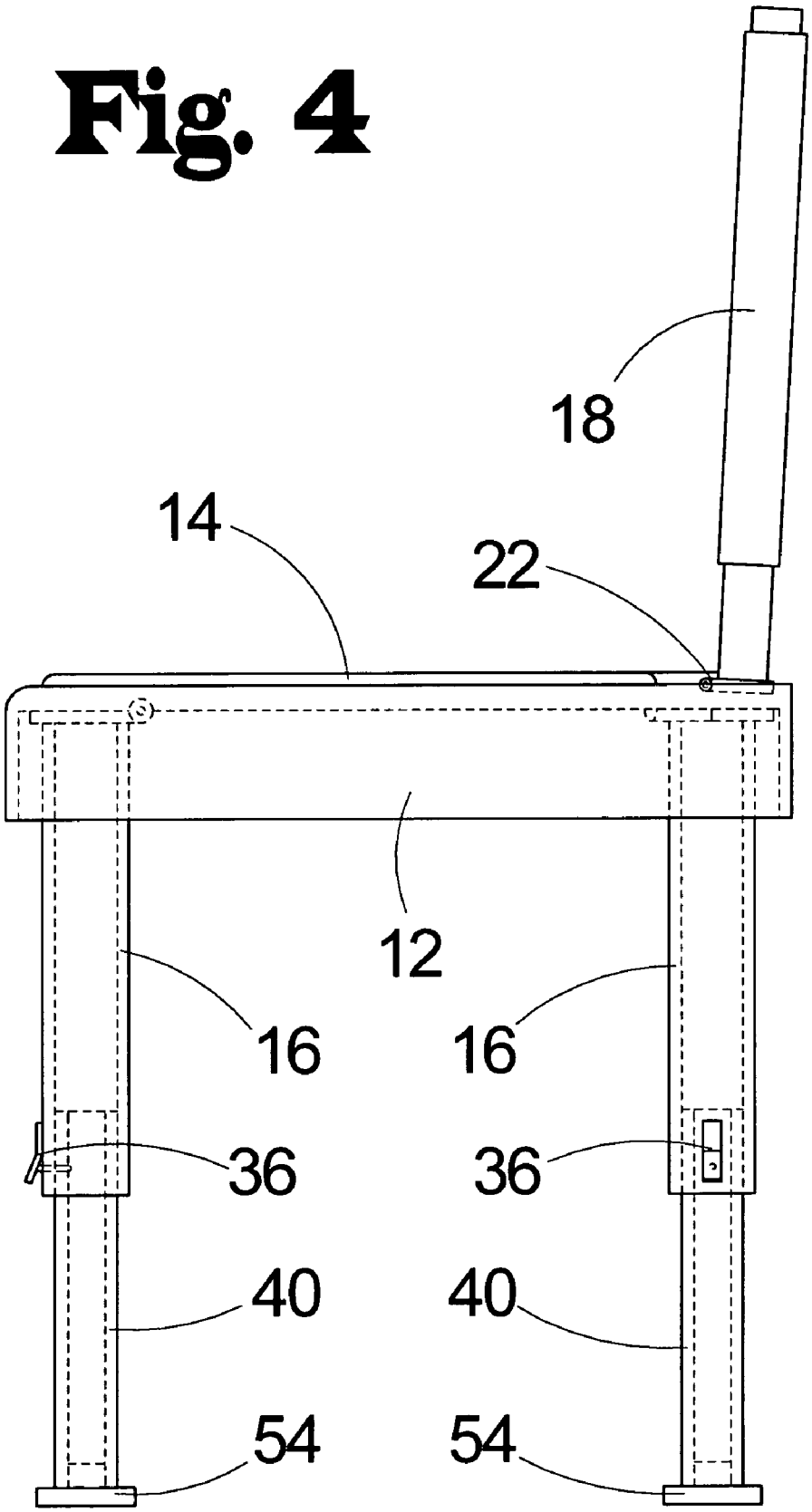
FIG. 4 is a side view of the present invention in an expanded position.
Figure 5:
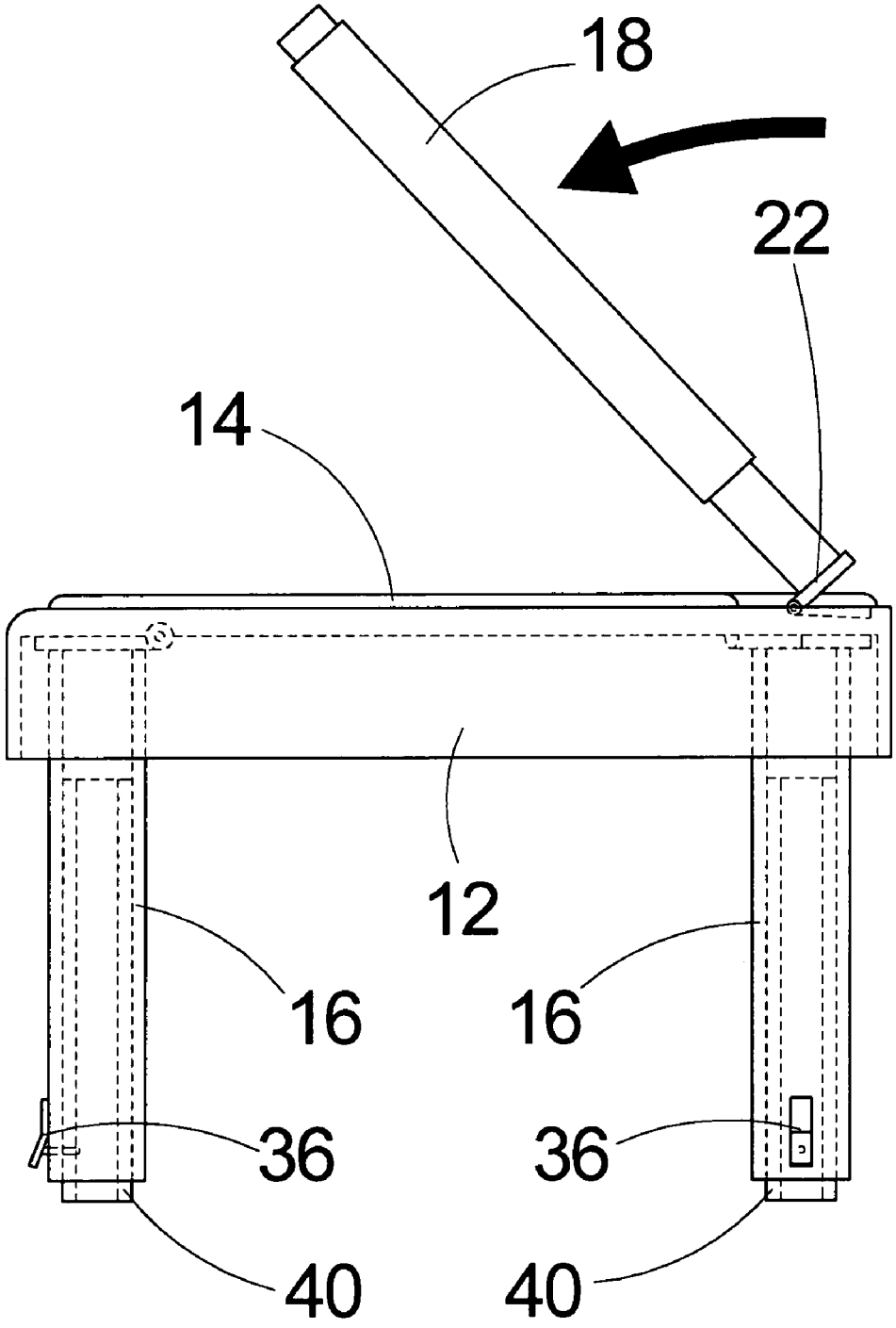
FIG. 5 is a side view of the present invention with the legs in a retracted position with the back partially collapsed.
Figure 6:
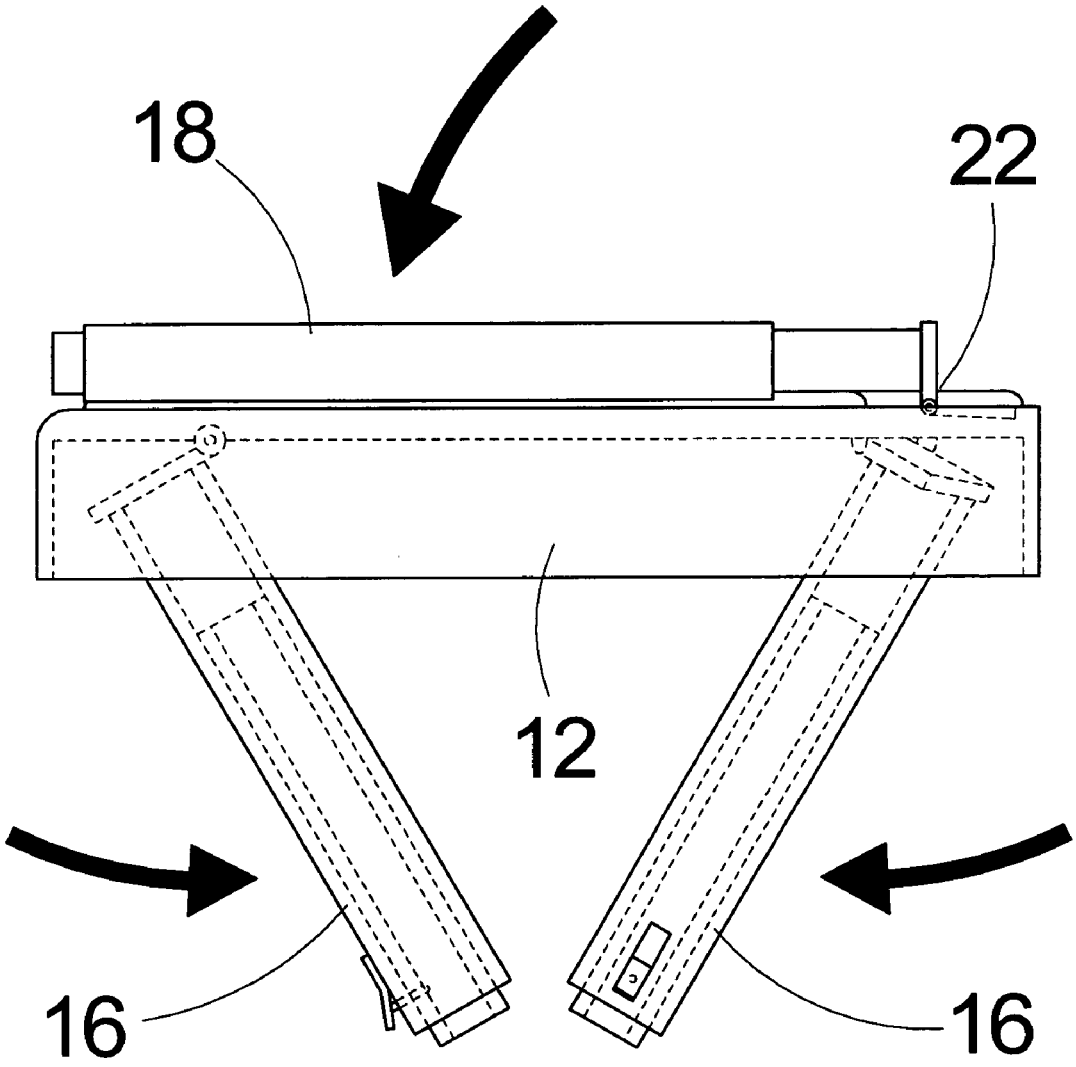
FIG. 6 is a side view of the present invention with the legs in a retracted partially collapsed position and the back in a collapsed position.
Figure 7:
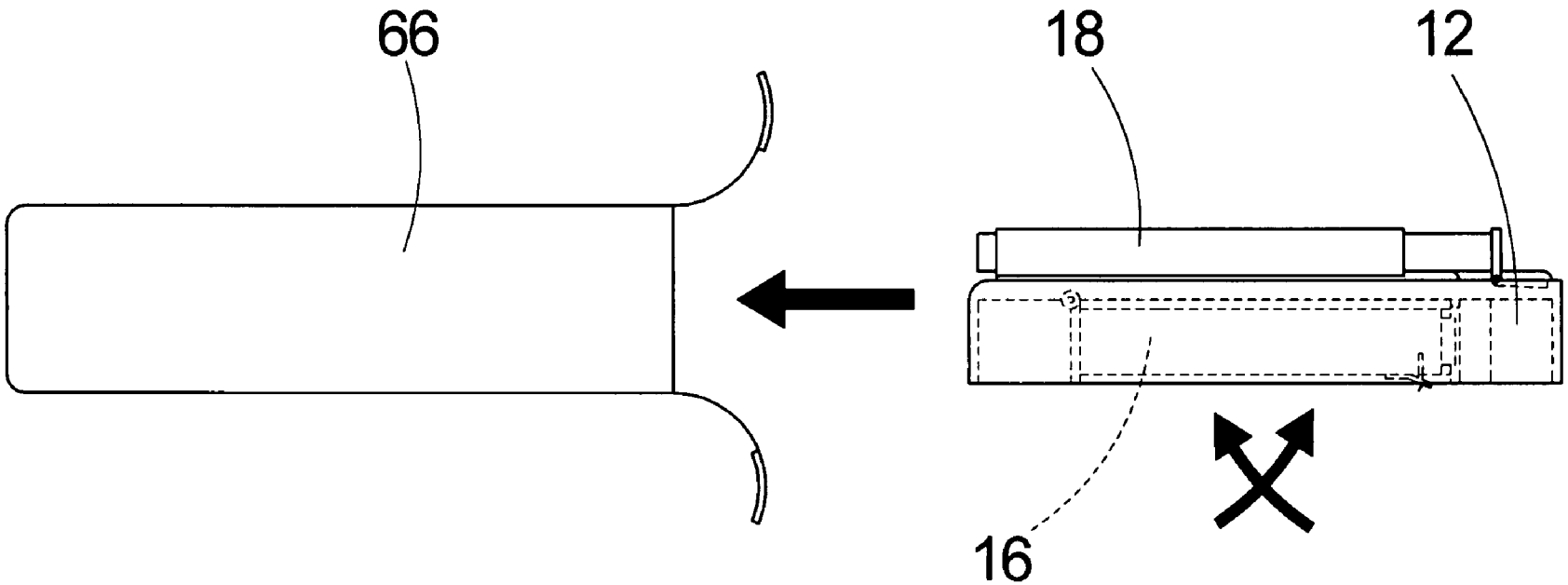
FIG. 7 is a side view of the present invention in a fully retracted and collapsed position.
Figure 8:
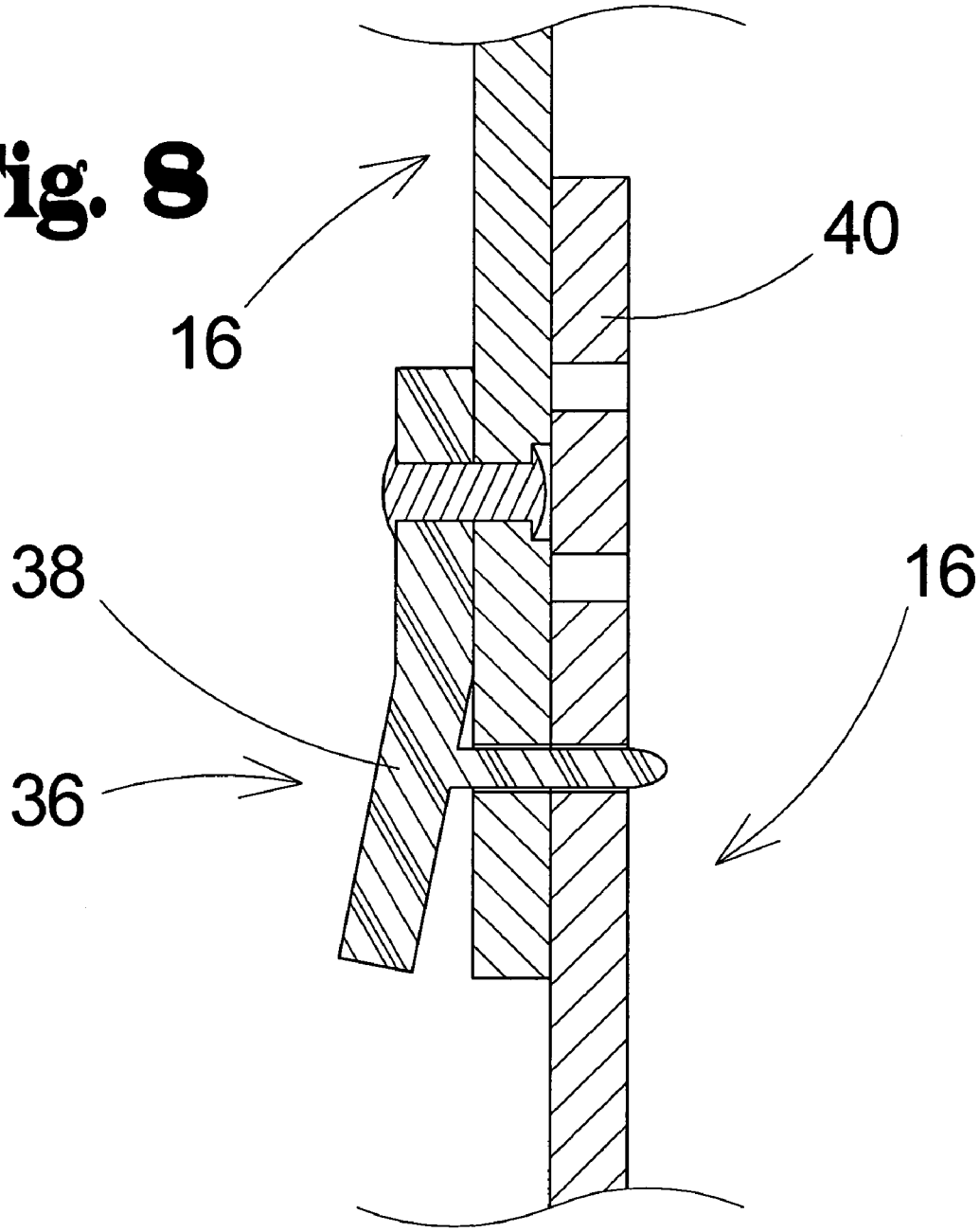
FIG. 8 is a partial cross-section of a leg of the present invention.

With reference now to the drawings, and in particular to FIGS. 1 through 8 thereof, a new collapsible chair assembly embodying the principles and concepts of the present invention will be described.

As best illustrated in FIGS. 1 through 8, the collapsible chair assembly generally comprises a base portion 12 that includes an upper surface 14 designed for supporting a user. A plurality of legs 16 are pivotally coupled to the base portion 12 such that each leg 16 pivots between a collapsed position and a use position. A back portion 18 is formed by a pair of posts 20 extending from planar base members 22 pivotally coupled to the base portion 12 and a flexible sheet member 24 extending between the posts 20.

The base portion 12 has a generally planar middle portion 26 and a perimeter wall 28 extending down from edges 30 of the middle portion 26. A thickness of each leg 16 is less than a depth of the perimeter wall 28. The base portion 12 also includes an underside surface 32. Each the leg 16 extends in a parallel position relative to the underside surface 32 of the base portion 12 when the leg 16 is in the collapsed position.

Each leg 16 is telescopic. A locking means 36 is provided on each leg 16 for holding each leg 16 at a desired length. A common locking means may be used but it is preferred that each leg 16 is adjustable individually to permit positioning of each leg 16 at a unique length if so desired to facilitate level positioning of the upper surface 14 of the base portion 12 on an uneven supporting surface. The locking means 36 preferably comprises a spring loaded locking member 38 that is biased into engagement with an outer telescoping portion 40 of each leg 16. Manipulation of the locking member releases the outer telescoping portion of the leg to permit extension or retraction of the leg.

The plurality of legs 16 includes a pair of back legs 42. Each of the back legs 42 is pivoted to extend from a respective corner 44 of the base portion 12 towards a center 46 of the base portion 12 when in the collapsed position. The plurality of legs 16 also includes a pair of front legs 48. Each of the front legs 48 is pivoted to extend from a respective corner 50 of the base portion 12 along an adjacent side 52 of the perimeter wall 28 towards an opposite corner from which an adjacently positioned one of the back legs 42 extends. Alternately, the front and back legs may be reversed in position.

The back portion 1–8 pivots between being parallel to the upper surface 14 of the base portion 12 and a use position. The posts 20 form an obtuse angle with respect to the upper surface 14 of the base portion 12 when in the use position.

The invention also provides a plurality of foot members 54. Each foot member 54 includes an inner perimeter wall 56 sized to frictionally engage a bottom 58 of each leg 16. Each foot member 54 has an area greater than a cross-sectional area of the bottom 58 of each of the legs 16 such that use of each of the foot members 54 enhances stable positioning of the leg members 16 on a supporting ground surface, particularly when the ground surface is covered with or formed by loose materials such as sand, pebbles, and the like. Raised portions 60 are positioned on the underside surface 32 of the base portion 12 to frictionally engage the foot members 54 to permit storage of the foot members 54 when not in use.

Preferably, the upper surface 14 of the base portion 12 is cushioned and all materials used are preferably non-absorbent or waterproof materials to prevent absorption of fluids resulting in increased weight, mold development, and other undesirable conditions.

A carrying case 66 is provided. The carrying case 66 is shaped for receiving the base portion 12, the legs 16, and the back portion 18 when the legs 16 and back portion 18 are in the collapsed position.

In use, the legs are pivoted into a use position and extended to desired lengths. If desired, the foot members are attached to the bottoms of the legs. The back is pivoted into a use position. The chair is then used in conventional fashion.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A collapsible chair assembly comprising:

a base portion having an upper surface adapted for supporting a user;

a plurality of legs, each of said legs being pivotally coupled to said base portion such that each leg pivots between a collapsed position and a use position;

a back portion formed by a pair of posts extending from planar base members pivotally coupled to said base portion and a flexible sheet member extending between the posts; and said plurality of legs including a pair of back legs, each of said back legs being pivoted to extend from a respective corner of the base portion towards a center of said base portion when in said collapsed position, each of said back legs extend from the respective corner towards a diametrically positioned corner such that said back legs converge towards said center of said base portion when said back legs are in said collapsed position.

2. The collapsible chair assembly of claim 1 wherein said base portion has a generally planar middle portion and a perimeter wall extending down from the edges of said middle portion; and wherein a thickness of each said leg is less than a depth of said perimeter wall.

3. The collapsible chair assembly of claim 1, further comprising:

said base portion having an underside surface; and wherein each said leg extends in a parallel position relative to said underside surface of said base portion when said leg is in said collapsed position.

4. The collapsible chair assembly of claim 1 wherein each said leg is telescopic.

5. The collapsible chair assembly of claim 4, further comprising:

a locking means on each said leg for holding each said leg at a desired length.

6. The collapsible chair assembly of claim 5 wherein each said leg is adjustable individually to permit positioning of each said leg at a unique length to facilitate level positioning of said upper surface of said base portion on an uneven supporting surface.

7. The collapsible chair assembly of claim 5 wherein said locking means comprises a spring loaded locking member that is biased into engagement with an outer telescoping portion of each said leg.

8. The collapsible chair assembly of claim 1 wherein said plurality of legs includes a pair of front legs; and each of said front legs being pivoted to extend from a respective corner of said base portion along an adjacent side of said perimeter wall towards an opposite corner from which an adjacently positioned one of said back leg extends.

9. The collapsible chair assembly of claim 1 wherein said back portion pivots between being parallel to said upper surface of said base portion and a use position wherein said posts form an obtuse angle with respect to said upper surface of said base portion.

10. The collapsible chair assembly of claim 1, further comprising:

a plurality of foot members, each foot member having an inner perimeter wall sized to frictionally engage a bottom of each said leg.

11. The collapsible chair assembly of claim 10 wherein each foot member has an area greater than a cross-sectional area of said bottom of each of said legs such that use of each of said foot members enhances stable positioning of said leg members.

12. The collapsible chair assembly of claim 11, further comprising:

raised portions on an underside surface of said base portion to frictionally engage said foot members to permit storage of said foot members when not in use.

13. The collapsible chair assembly of claim 1 wherein said upper surface of said base portion is cushioned.

14. The collapsible chair assembly of claim 1, further comprising:

a carrying case shaped for receiving said base portion, said legs, and said back portion when said legs and back portion are in said collapsed position.

15. A collapsible chair assembly comprising:

a base portion having an upper surface adapted for supporting a user;

a plurality of legs, each of said legs being pivotally coupled to said base portion such that each leg pivots between a collapsed position and a use position;

a back portion formed by a pair of posts extending from planar base members pivotally coupled to said base portion and a flexible sheet member extending between the posts;

said base portion having a generally planar middle portion and a perimeter wall extending down from the edges of said middle portion;

wherein a thickness of each said leg is less than a depth of said perimeter wall;

said base portion having an underside surface;

wherein each said leg extends in a parallel position relative to said underside surface of said base portion when said leg is in said collapsed position;

each said leg being telescopic;

a locking means on each said leg holding each said leg at a desired length;

each said leg being adjustable individually to permit positioning of each said leg at a unique length to facilitate level positioning of said upper surface of said base portion on an uneven supporting surface;

said locking means comprising a spring loaded locking member that is biased into engagement with an outer telescoping portion of each said leg;

said plurality of legs including a pair of back legs, each of said back legs being pivoted to extend from a respective corner of the base portion towards a center of said base portion when in said collapsed position, each of said back legs extend from the respective corner towards a diametrically positioned corner such that said back legs converge towards said center of said base portion when said back legs are in said collapsed position;

said plurality of legs including a pair of front legs;

each of said front legs being pivoted to extend from a respective corner of said base portion along an adjacent side of said perimeter wall towards an opposite corner from which an adjacently positioned one of said back leg extends;

said back portion pivoting between being parallel to said upper surface of said base portion and a use position wherein said posts form an obtuse angle with respect to said upper surface of said base portion;

a plurality of foot members each having an inner perimeter wall sized to frictionally engage a bottom of each said leg;

each foot member having an area greater than a cross-sectional area of said bottom of each of said legs such that use of each of said foot members enhances stable positioning of said leg members; and raised portions on an underside surface of said base portion frictionally engaging said foot members to permit storage of said foot members when not in use.

16. The collapsible chair assembly of claim 15 wherein said upper surface of said base portion is cushioned.

17. The collapsible chair assembly of claim 15, further comprising:

a carrying case shaped for receiving said base portion, said legs, and said back portion when said legs and back portion are in said collapsed position.

* * * * *